US010414580B2

(12) United States Patent
Buse et al.

(10) Patent No.: US 10,414,580 B2
(45) Date of Patent: Sep. 17, 2019

(54) PACK FOR CIGARETTES

(71) Applicant: Focke & Co. (GmbH & Co. KG), Verden (DE)

(72) Inventors: Henry Buse, Visselhövede (DE); Christoph Schneider, Verden (DE); Viktor Hein, Kirchlinteln-Luttum (DE); Jan Schnakenberg, Blender (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 0 days.

(21) Appl. No.: 15/777,961

(22) PCT Filed: Dec. 12, 2016

(86) PCT No.: PCT/EP2016/002087
§ 371 (c)(1),
(2) Date: May 22, 2018

(87) PCT Pub. No.: WO2017/108164
PCT Pub. Date: Jun. 29, 2017

(65) Prior Publication Data

US 2018/0346235 A1 Dec. 6, 2018

(30) Foreign Application Priority Data

Dec. 21, 2015 (DE) ..... 10 2015 016 456

(51) Int. Cl.
*B65D 85/10* (2006.01)
*B65D 75/58* (2006.01)

(52) U.S. Cl.
CPC ..... *B65D 85/1045* (2013.01); *B65D 75/5838* (2013.01)

(58) Field of Classification Search
CPC ..... B65D 5/54; B65D 65/14; B65D 75/5833; B65D 75/5838; B65D 77/02; B65D 77/04; B65D 85/1018; B65D 85/1045
USPC ..... 206/245, 265, 268, 271, 273; 229/87.14, 229/160.1
See application file for complete search history.

(56) References Cited

U.S. PATENT DOCUMENTS 4,948,038 A 8/1990 Moeller
8,474,612 B2 * 7/2013 Bertuzzi ..... B65D 75/5838 206/264

(Continued)

FOREIGN PATENT DOCUMENTS

CN 103228557 A 7/2013
DE 2560611 C2 7/1988

(Continued)

OTHER PUBLICATIONS

WIPO, International Search Report (on parent application), dated Feb. 6, 2017.

(Continued)

*Primary Examiner* — Luan K Bui
(74) *Attorney, Agent, or Firm* — Laurence P. Colton; Smith Tempel Blaha LLC

(57) ABSTRACT

A cigarette pack having a foil block as an inner pack and a hinge-lid box as an outer pack is configured with an opening aid for the foil block, in which a closure tab for exposing a retrieval opening of the foil block is connected with a lid inner flap as part of the lid front wall. The lid inner flap is movable or pivotable, respectively. A relative movement of the lid inner flap takes place so as to be tuned to the opening procedure of the closure tab when the lid is opened.

25 Claims, 11 Drawing Sheets

(56) References Cited

U.S. PATENT DOCUMENTS

| | | | | |
|---|---|---|---|---|
| 2010/0230303 | A1* | 9/2010 | Buse | B65D 5/38 206/268 |
| 2010/0252462 | A1* | 10/2010 | Marchetti | B65D 5/606 206/268 |
| 2011/0114518 | A1* | 5/2011 | Hein | B65B 19/20 206/268 |
| 2012/0111746 | A1 | 5/2012 | Tanbo | |
| 2014/0110286 | A1* | 4/2014 | Bertuzzi | B65D 75/5894 206/268 |
| 2014/0374290 | A1* | 12/2014 | Seyfferth De Oliveira | B65D 85/1045 206/268 |
| 2015/0021219 | A1* | 1/2015 | Seyfferth De Oliveira | B65D 85/1045 206/268 |
| 2015/0034509 | A1* | 2/2015 | Seyfferth De Oliveira | B65D 85/1045 206/268 |
| 2015/0041346 | A1* | 2/2015 | Seyfferth De Oliveira | B65D 85/1045 206/268 |

FOREIGN PATENT DOCUMENTS

| | | | |
|---|---|---|---|
| DE | 102010019867 | A1 | 9/2011 |
| DE | 102011008666 | A1 | 7/2012 |
| GB | 2520992 | A | 6/2015 |
| TW | 201315396 | A | 4/2013 |
| WO | 2008087378 | A1 | 7/2008 |
| WO | 2008142540 | A1 | 11/2008 |
| WO | 2013120913 | A1 | 8/2013 |
| WO | 2014082717 | A1 | 6/2014 |

OTHER PUBLICATIONS

Deutsches Patent Und-Markenamt (German Patent and Trademark Office), Recherchenbericht (search in connection with related application), dated Jul. 27, 2016.

China National Intellectual Property Administration, Notification of the First Office Action (in a related application), dated May 15, 2019.

* cited by examiner 18
20
19
17
57
58
54
60
55
13
34
10
53
24
49
51
27
33
31
29
30
14
11
25
28
26

27
17
20
33
31
49
53
51
24
50
54
55
13
34
58
60
10
18
19
29
23
30
14
11
25
28
26

PACK FOR CIGARETTES

CROSS-REFERENCE TO RELATED APPLICATIONS

The application is the US PCT National Phase of International Application No. PCT/EP2016/002087 having an International Filing Date of 12 Dec. 2016, which claims priority on German Patent Application No. 10 2015 016 456.2 having a filing date of 21 Dec. 2015.

BACKGROUND OF THE INVENTION

Technical Field

The invention relates to packs for cigarettes or other smokers' items, having an outer pack, preferably in the embodiment as a hinge-lid box/hinge-lid pack, having a box part and a lid, and having an inner pack in the embodiment as a (sealed) foil block having a blank from foil which preferably surrounds a cigarette group on all sides, wherein the foil block, preferably in the end-side region of an inner front wall of the foil block and at least in a part-region of an inner end wall, has an opening aid, wherein the opening aid has a closure means or closure tab, which is fastened to the foil block by means of a releasable adhesive bond and for opening the foil block is at least partially torn off from the latter and on account thereof at least partially exposes a retrieval opening.

Prior Art

Sealed packs for cigarettes, in particular in the embodiment as a hinge-lid box, are preferably composed of a foil or sealed block, respectively, as the inner pack, and of an outer pack. The sealed block is provided with an opening aid in the case of which a closure tab which can be used multiple times and is fixed by a suitable adhesive by tearing off can be moved to the open position and thereafter back to the closed position. A retrieval opening of the foil block is exposed in the open position.

Packs in which the closure tab by way of an activation flap is fixed to the inner side of a lid, lid front wall, of a hinge-lid box as an outer pack are also already known. Accordingly, the closure tab is conjointly moved (in a self-acting manner) to the opening position when the lid of the outer pack is opened. The closure position is thus also achieved when the lid is closed (WO 2013/120913).

BRIEF SUMMARY OF THE INVENTION

It is an object of the invention to refine and to improve the technology in terms of the construction, the functionality, and the production of sealed packs for cigarettes, in particular in terms of the structure of the opening aid.

In order for this object to be achieved, the pack according to the invention is configured having an outer pack, preferably in the embodiment as a hinge-lid box/hinge-lid pack, having a box part and a lid, and having an inner pack in the embodiment as a (sealed) foil block having a blank from foil which preferably surrounds a cigarette group on all sides, wherein the foil block, preferably in the end-side region of an inner front wall of the foil block and at least in a part-region of an inner end wall, has an opening aid, wherein the opening aid has a closure means or closure tab, which is fastened to the foil block by means of a releasable adhesive bond and for opening the foil block is at least partially torn off from the latter and on account thereof at least partially exposes a retrieval opening, characterized by the following features:

a) the closure tab by way of a grip end, preferably by way of a (glue-free) connection flap, is connected to a movable, in particular pivotable, (activation) flap of the lid of the outer pack; and b) when opening the lid, the closure flap by virtue of a tuned movement, in particular by virtue of a pivoting movement, of the (activation) flap relative to the lid, is movable to an open position.

The primary focus is accordingly the opening and closing procedure of the foil block or sealed block when a lid of the outer pack is activated.

According to the invention, the connection between the closure tab, on the one hand, and the lid, on the other hand, by way of the movable activation flap on the lid is configured such that during the opening procedure a relative movement between the activation flap, on the one hand, and the lid, on the other hand, takes place, specifically so as to be tuned with the opening or closing movement of the closure tab. The latter at a specific relative position transmits a (tensile) force to the lid, or to the lid front wall, respectively, such that a tension that facilitates the opening procedure is created at said relative position. The relative movement of the lid, the activation flap, and the closure tab is performed in the reverse order when closing the lid.

According to one particular embodiment of the pack, a lid inner flap serves as the activation flap for the closure tab. The lid inner flap is not connected to the inner side of the lid front wall, but as a freely movable, specifically pivotable, flap is folded toward the inner side of the lid front wall. The lid inner flap thus disposed is connected to the lid front wall by way of (only) a folding edge, lid edge. The lid inner flap is pivotable along said lid edge. The closure tab, or the connection flap thereof, respectively, is connected to the free (inner) side of the lid inner flap by adhesive bonding. When opening the lid, the lid inner flap by virtue of (tensile) forces of the closure tab is gradually moved from the initial position to an almost stretched position (at an obtuse angle) in relation to the lid front wall. The closure tab in this terminal position is in an open position. The lid inner flap by virtue of a corresponding pretreatment, in particular by (transversely directed) embossing and/or punching lines is preferably configured such that the inner flap in the opening procedure of the lid carries out an "unrolling movement" that is adapted to the movement procedure, such that the opening of the lid, while entraining the closure tab of the inner pack, is performed without tensions in a lid front wall.

According to one particular alternative, the activation flap as a separate folding flap, or as a folding flap that is configured as part of the lid inner flap by punching, is disposed on the inner side of the lid front wall. The activation flap is formed by a preferably U-shaped punched feature in the region of the (conventionally configured) lid inner flap, specifically so as to be pivotable about a (linear) joint as the connection between the activation flap and the lid inner flap. The relative position is preferably chosen such that in the folded position of the lid inner flap according to the pack, and by way of a commonplace (adhesive) connection to the lid front wall, the pivot axis runs (approximately) parallel with the lid edge and, in the closed position, lies on that side that faces away from the lid edge.

A particularity lies in that this embodiment is advantageous for outer packs in the embodiment as a hinge-lid box having a (commonplace) collar. The (separate) activation flap is dimensioned such that the latter in the case of a closed lid finds a receptacle in the clearance of the collar front wall that is commonplace in the case of a collar, the pressure for connecting the activation tab to the closure tab, or to the closure flap, respectively, thereof being thus generated in the production of the pack.

One (other) peculiarity is the adhesive connection of the closure tab to the foil block. The latter forms a retrieval opening which is achieved either by (previous) punching of the foil, or of the blank, respectively, or which is created by detaching an opening tab with the aid of the closure tab. The closure tab is connected by a glue pattern that is configured so as to be U-shaped or frame-shaped, respectively, in the adhesive zone that is formed by the retrieval opening of the foil block. Said glue pattern is configured such that when initiating the opening procedure, thus directly after the activation of the connection flap, a relatively weaker adhesive bond is first effective. Said adhesive bond becomes more intense as the opening procedure progresses, thus as the closure tab is increasingly released.

Furthermore, the closure tab as the (outer) ply of a multi-ply foil can be integrated into the latter according to the invention.

A particular pack is configured such that an activation flap of the lid is configured as the continuation of the lid inner flap, preferably by folding the activation flap thus disposed toward the inner side of the lid inner flap. The latter and the activation flap can be folded on the inner side of the lid front wall without a reciprocal (glue) connection. An embodiment in which at least the lid inner flap is fixed to the inner side of the lid front wall by glue, and the (folded-over) activation flap is preferably likewise adhesively bonded to the outer side of the lid inner flap is advantageous. The activation flap thus disposed, in terms of size, shape, and relative position, is configured or disposed, respectively, such that the activation flap in the case of a closed lid finds a receptacle as is commonplace in the case of a collar of a hinge-lid box, collar front wall, and thus by way of the outer side bears on the closure tab, or on the connection flap of the latter, respectively, and is connected thereto (by glue).

BRIEF DESCRIPTION OF THE DRAWINGS

Exemplary embodiments of packs, of packaging material, and methods for producing packs are explained hereunder by means of the drawings in which.

DETAILED DESCRIPTION OF PREFERRED EMBODIMENTS

Figure 2:
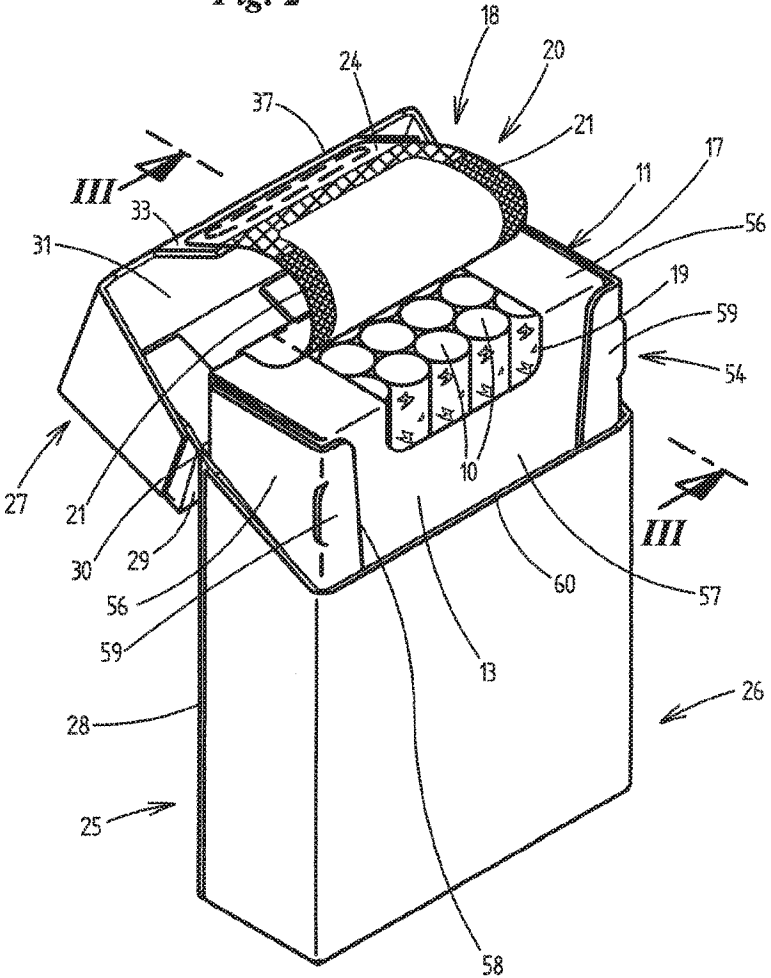
FIG. 2 shows a complete pack for cigarettes in the opened position, likewise in a perspective view.
Figure 1:
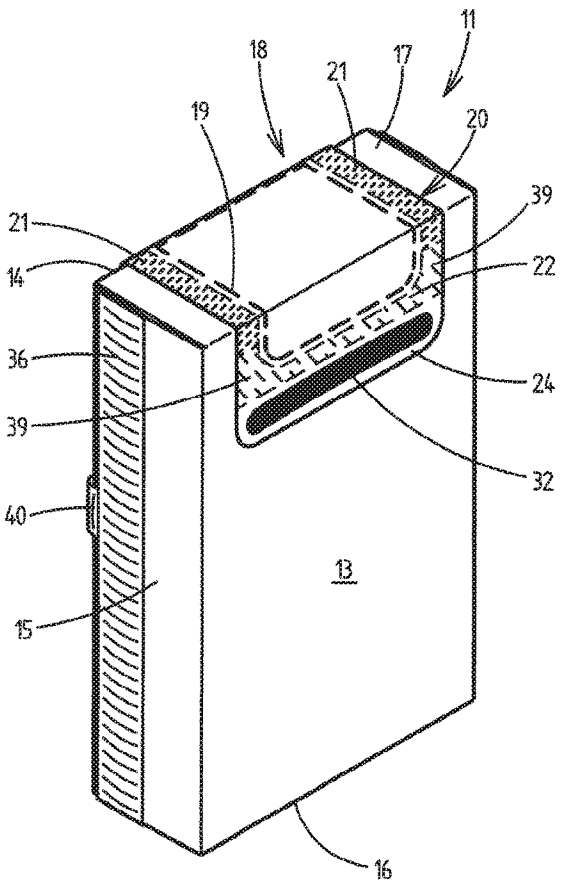
FIG. 1 shows a foil block, or sealed block, respectively, for cigarettes in a perspective illustration.

The drawings discuss the design of packs for cigarettes 10. A cigarette group in formation, in particular composed of rows, is the content of an inner pack, specifically of a foil block 11. The latter is preferably composed of one blank 12 from foil, in particular from a moisture-tight and aroma-proof foil. The group of cigarettes 10 is preferably completely, that is to say on all sides, sheathed by the blank 12, thus forming a sealed block having an inner front wall 13, an inner rear wall 14, inner side walls 15, an inner base wall 16, and an inner end wall 17.

The blank 12 is configured, or folded around the group of cigarettes 10, respectively, such that the inner end wall 17 is free of folds, instead forming a continuously closed wall. An opening aid 18 which enables easy access to the pack content, in particular in a self-acting manner, is attached in this region. The foil block 11 for this purpose forms a retrieval opening 19 in the region of the end-side. The retrieval opening 19 preferably extends transversely across the inner end wall 17 and in an adjoining, end-side portion of the inner front wall 13. The retrieval opening 19 is preferably disposed so as to be centric, in particular having a width that is (significantly) smaller than that of the foil block 11.

The retrieval opening 19 in the case of a closed pack is preferably completely covered by a closure means, in particular by a closure tab 20. The tab 20 laterally forms a preferably encircling, strip-type, projection in the manner of a frame, having longitudinal strips 21 and transverse strips 22. An anchor strip 23, in particular as a leg of the closure tab 20 in the region of the inner rear wall 14, is permanently connected to the foil block 11. The aforementioned peripheral strips 21, 22, 23 identify a glue pattern for connecting the closure tab 20 in an adhesive manner to the foil block 11, thus by way of a glue pattern that surrounds the retrieval opening 19 in the manner of a frame. At least the longitudinal strips 21 and the transverse strip 22 are fixed by way of a releasable and repeatedly effective adhesive, in particular a so-called pressure-sensitive adhesive (PSA).

The closure tab 20 in an end region, specifically in the region of a leg that protrudes into the inner front wall 13, is provided with a grip or connection flap 24, respectively. Should the closure tab 20 be intended to be manually activated, the connection flap 24 on that side that faces the inner front wall 13 is glue-free. The activation tab preferably extends across the full width of the closure tab 20, being a peripheral strip of the latter.

The foil block 11 as an inner pack is disposed in an outer pack 25, preferably in the embodiment of a hinge-lid box having a box part 26 and the lid 27. The latter in the region of a box rear wall 28 is pivotably connected to a lid rear wall 29 by way of a linear joint.

The closure tab 20, in particularly the connection flap 24 thereof, is connected to the lid 27 in such a manner that when opening said lid 27, the closure tab 20 likewise reaches an open position (FIG. 3 to FIG. 6). For this purpose, the closure tab 20, or the connection flap 24, respectively, is connected to the lid 27, or to a connector flap, respectively, the latter being part of the lid 27 or being connected thereto, respectively. In particular, the connection flap 24 is connected to part of a lid front wall 31 of the lid 27, specifically in a permanent manner by glue strips 32 that preferably extend in the longitudinal direction of the connection flap 24 (and/or glue spots 41). Said part of the lid front wall 31 is attached to the outer side of the connection flap 24. In the production of the pack, or of the outer pack 25, respectively, the connection to the connection flap 24 in the closed position of the lid 27 is established by way of the glue strip 32 (or by way of the glue spots 41, respectively), optionally by way of a temporary contact pressure which is exerted on the outer side of the lid front wall 31.

The closure tab 20, or the connection flap 24 thereof, respectively, is preferably attached to a lid inner flap 33 as a folding flap that is (integrally) connected to the lid front wall 31. The lid inner flap 33 is preferably connected to the lid front wall 31 only along a folding edge 37. This folding edge 37 is simultaneously the lid or closing edge, respectively, on the front side. Accordingly, the lid inner flap 33 is not connected (by glue) to the inner side of the lid front wall 31.

Figure 4:
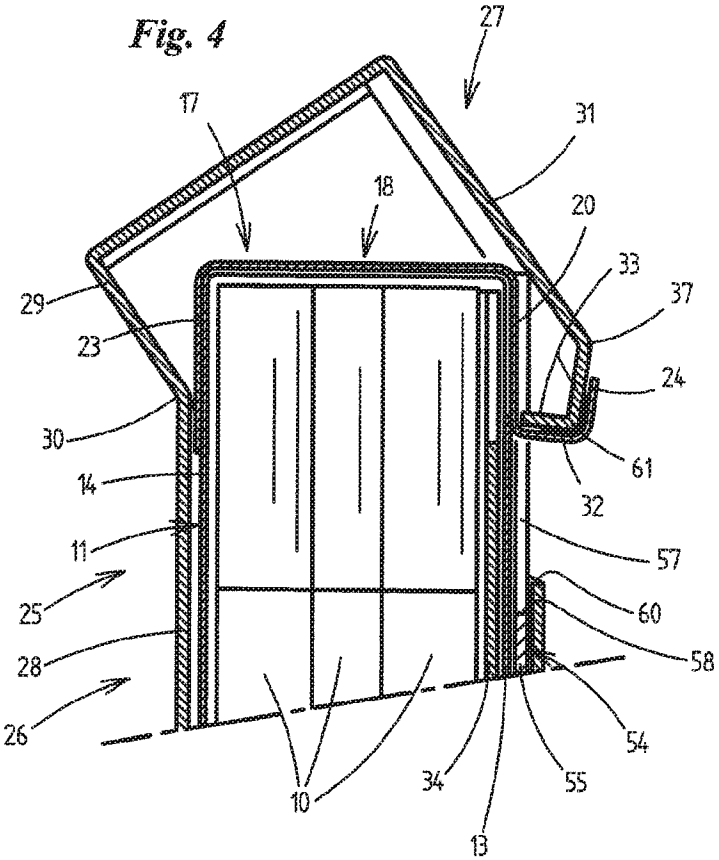
FIG. 4 shows an illustration corresponding to that of FIG. 3, in the case of a continued opening process.
Figure 5:
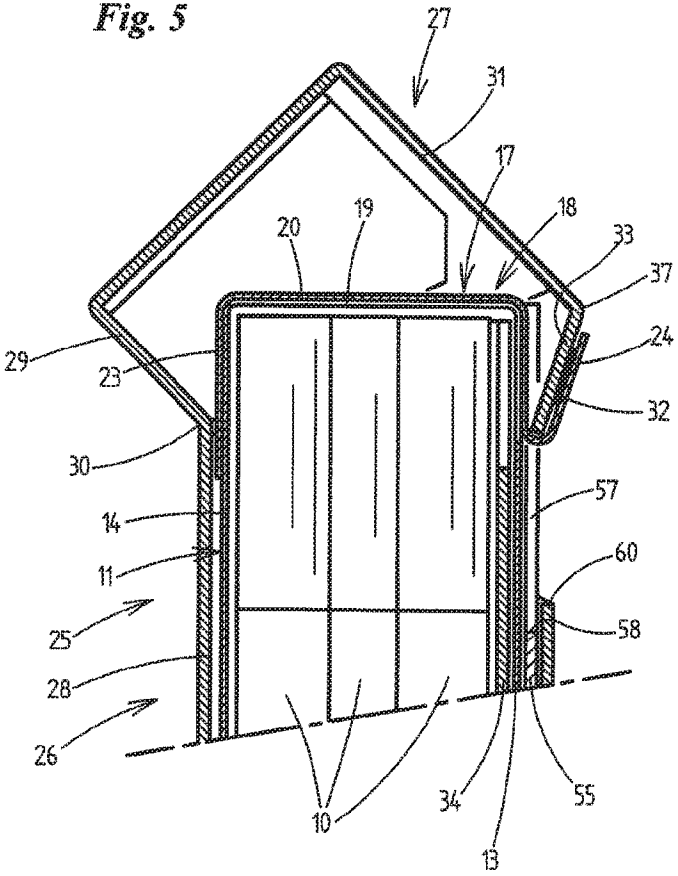
FIG. 5 shows a final phase when opening the lid.

The (permanent) fastening of the connection flap 24 to the (free, inwardly directed side) of the freely movable, or pivotable, respectively, lid inner flap 33 leads to particular kinematics when opening and closing the pack, or the lid 27, respectively. At the beginning of the opening procedure (FIG. 3) the lid inner flap 33, in the case of a corresponding position of the connection flap 24, makes its way to a relative position at an acute angle. In the case of a continued opening movement of the lid 27, the connection flap 24 and the lid inner flap 33 first make their way to a transverse position (FIG. 4) and thereafter to an upright position (FIG. 5).

Figure 3:
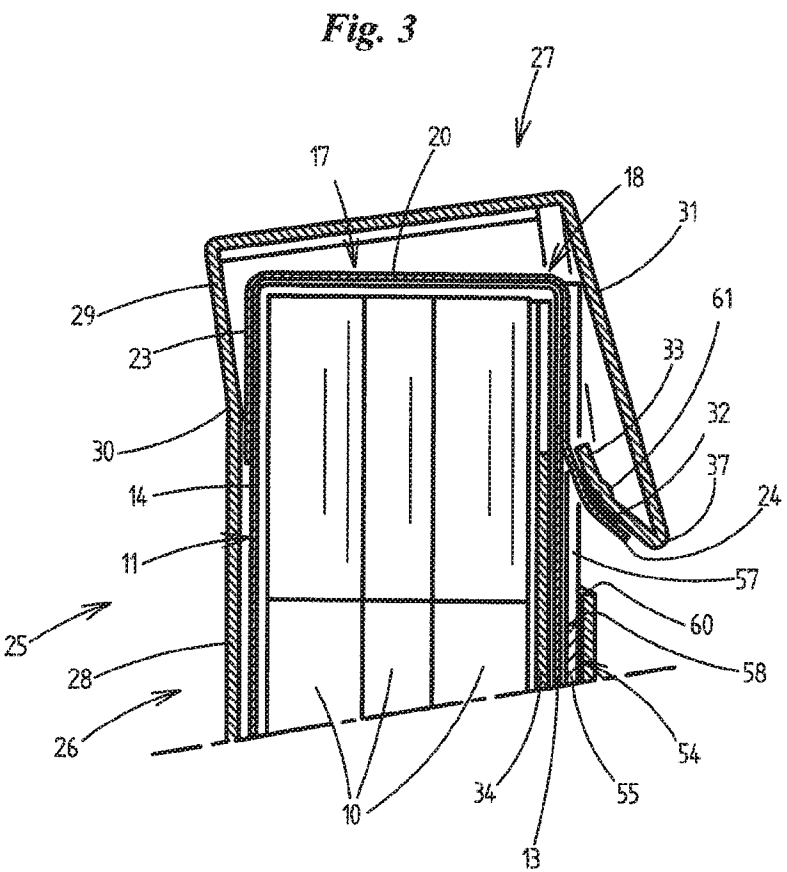
FIG. 3 shows an (upper) part-region on the lid of the pack in FIG. 2, in a vertical section III-III, in an initial phase of opening.
Figure 6:
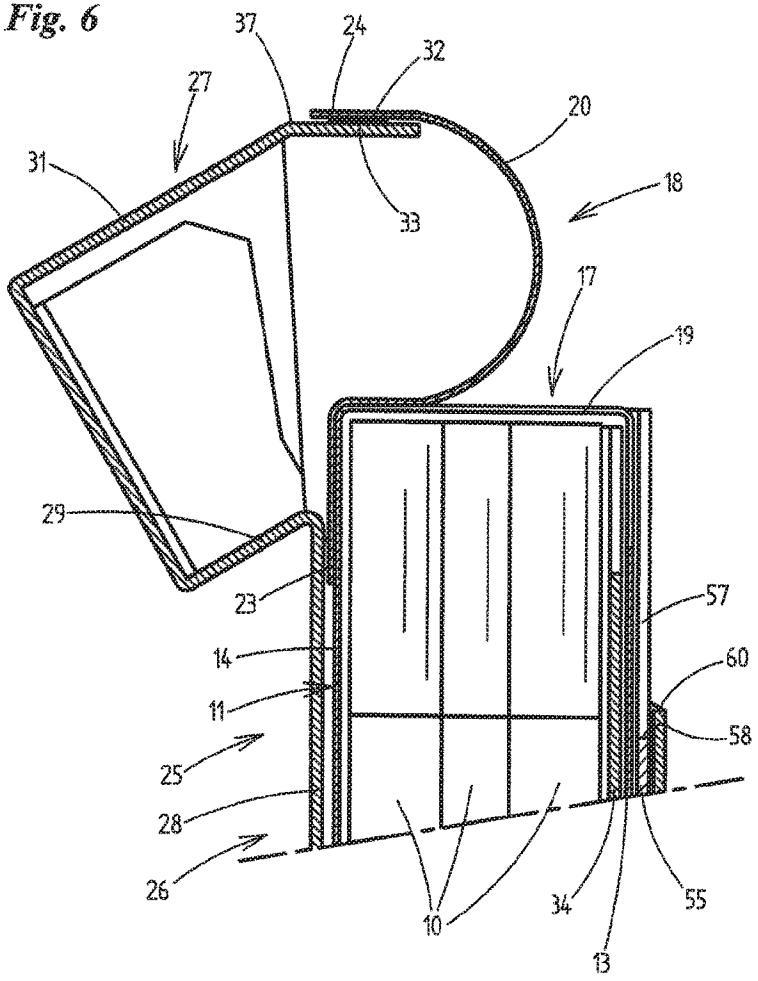
FIG. 6 shows the pack in the case of an opened lid and an opened foil block.

A configuration of the lid 27 in such a manner that an adaptation to the particular motion sequence of the lid 27 and the closure tab 20 takes place in the opening procedure is advantageous. The lid inner flap 33 by way of an embossed feature and/or by punched features is prepared such that an adaptive deformation of the lid inner flap 33 takes place in the opening procedure (FIG. 3, FIG. 4). In the case of the exemplary embodiment shown, a single embossed line 61 which is disposed so as to be approximately centric and to run transversely is provided, said embossed line 61 guaranteeing a buckled position of the lid inner flap 33 in the sequence of the opening procedure. The embossed line 61 is preferably disposed such that an embossing pressure of a respective tool is applied to the free side and a bulge-type inward deformation, in the direction toward the lid front wall 31, is thus provided. The effect can be enhanced in that a plurality of preferably parallel embossed features or embossed lines, and/or transversely-directed punched lines, in particular perforation lines, are applied. Said embossed or punched features can have the effect that a type of unrolling movement of the flap 33 arises in the opening and closing procedure.

By virtue of the (tuned) dimension of the lid inner flap 33 and of the dimensional stability of the material (the outer pack 25 is preferably composed of thin cardboard) a tension in the lid front wall 31 which can lead to a ready deformation of the latter is generated in the transverse position of the lid inner flap 33 (FIG. 4). The lid inner flap 33 in terms of the width is preferably dimensioned such that a support of a free periphery can take place on the foil block 11 in this intermediate position. Furthermore, a slightly curved deformation of the lid front wall 31 arises.

In the case of a continued movement, a folding function takes place, optionally having a respective sound. The motion sequence leads to a stable relative position (FIG. 5). The opening procedure of the closure tab 20, by releasing the adhesive connection to the foil block 11, preferably begins only once the stable folded-over position according to FIG. 5 has been reached and in the case of a further opening movement of the lid 27. The lid inner flap 33 finally makes its way to an end position at an obtuse angle to the lid front wall 31, or to a stretched position (FIG. 6), respectively. A functional sequence in the reverse order results when the lid 27 is closed conjointly with the closure tab 20.

The foil block 11 is preferably configured as a sealed block. A cover or support element, respectively, presently a tray 34, can be disposed within the inner pack that is closed on all sides, in particular in the embodiment having a front wall, side flaps, and a base wall. The group of cigarettes 10 is directly surrounded by the tray 34.

The foil block 11 that is composed of a preferably heat-sealable foil is provided with seal seams, in particular with lateral seams 36 in the region of the inner side walls 15, and with a transverse seam 40 in the region of the inner rear wall 14. Said seams 36, 40 which are produced by sealing are preferably configured as fin seams.

Figure 7:
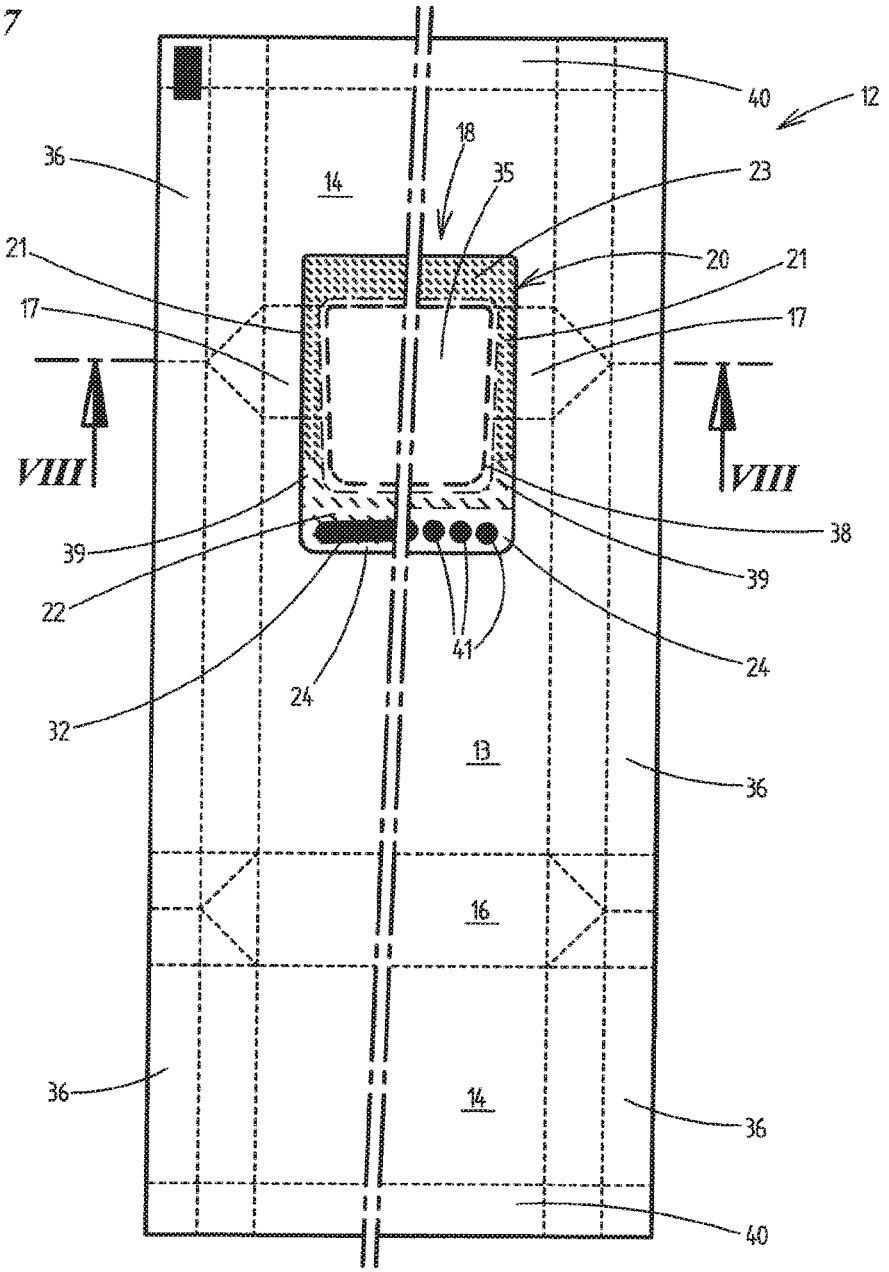
FIG. 7 shows a spread-out blank for a foil block according to FIG. 1.
Figure 8:
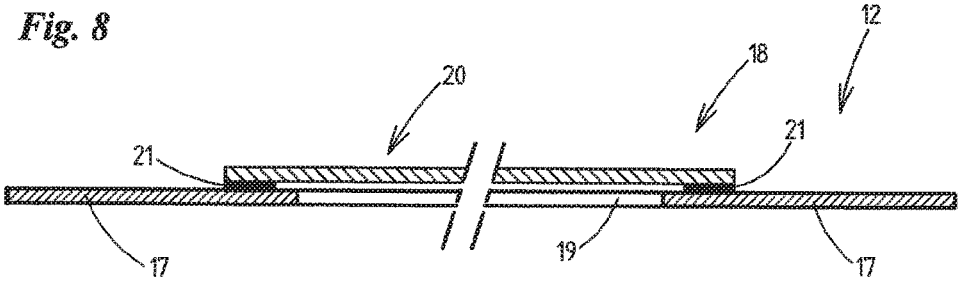
FIG. 8 shows a cross section VIII-VIII of the blank in FIG. 7, on an enlarged scale.
Figure 10:
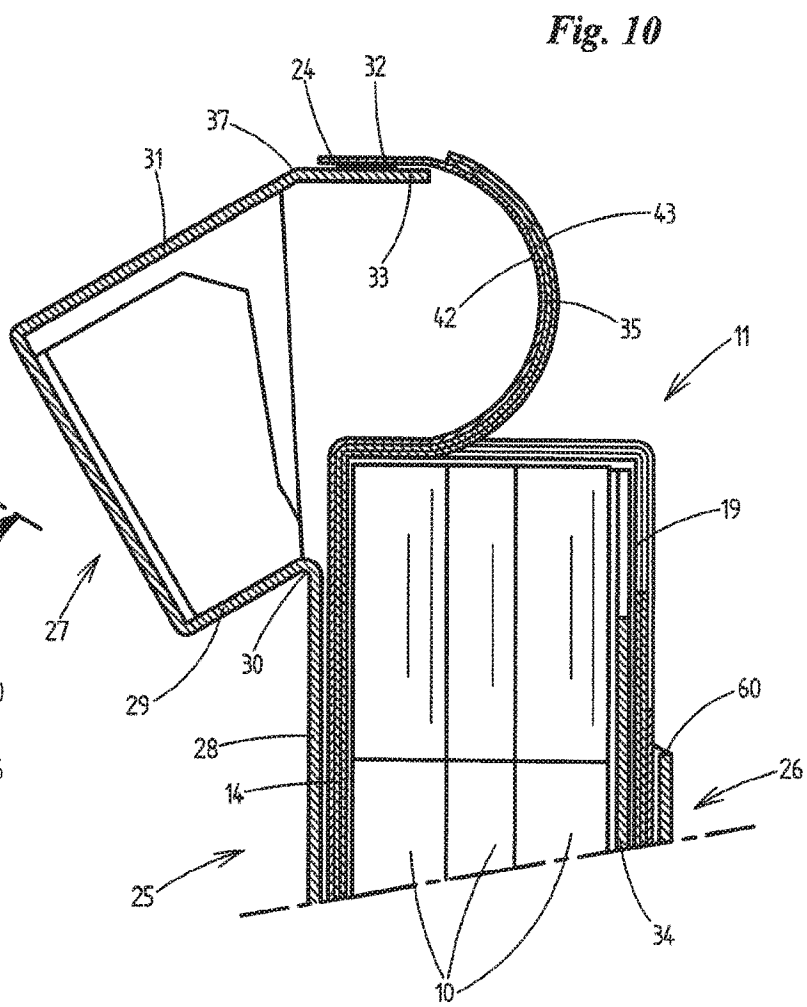
FIG. 10 shows a vertical section X-X of an (upper) region on the lid of the pack according to FIG. 9, on an enlarged scale.
Figure 9:
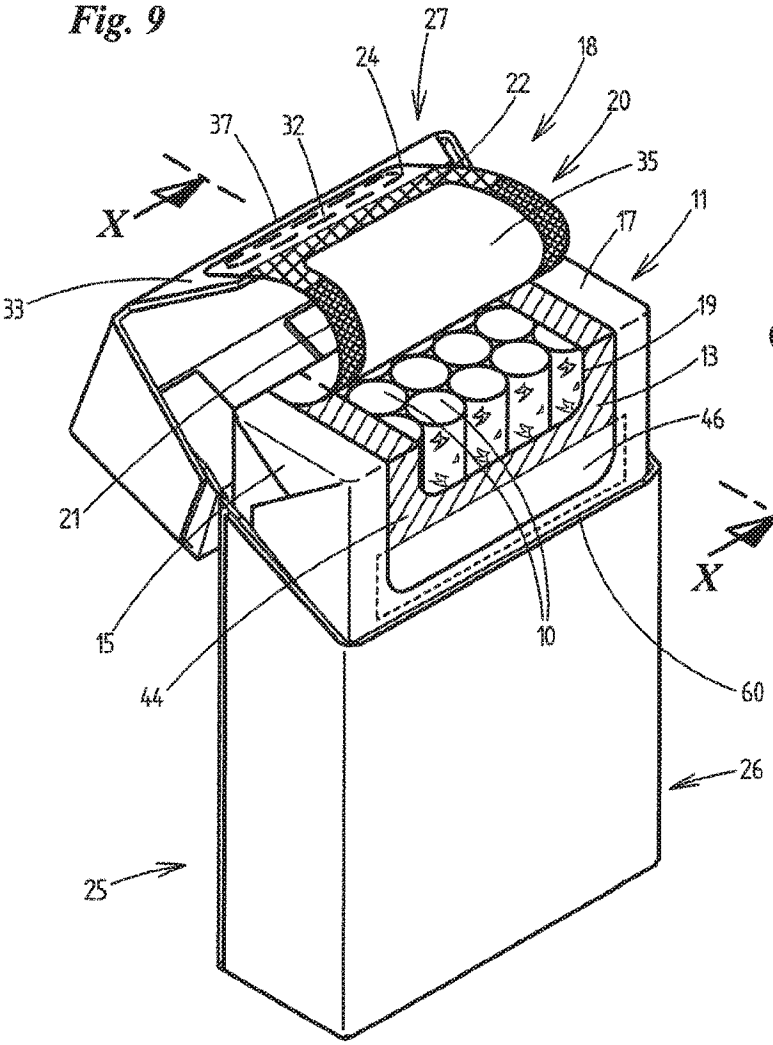
FIG. 9 shows an illustration in an analogous manner to that of FIG. 2, for another embodiment of the pack in the open position.
Figure 11:
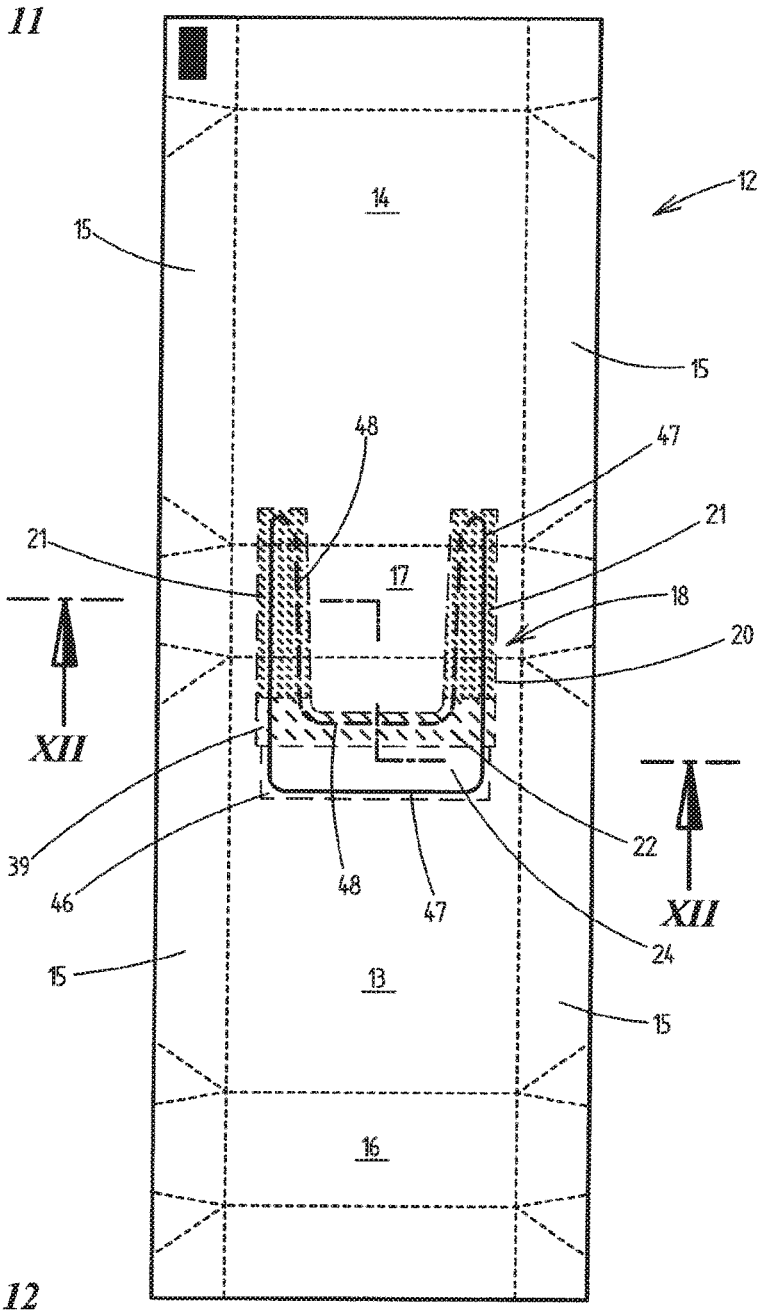
FIG. 11 shows a spread-out blank for a foil block or sealed block, respectively, according to FIG. 9, FIG. 10.

The foil block 11 is produced from a blank 12 which is preferably severed from a continuous foil web. FIG. 7 shows imaginary folding lines for the pack faces of the foil block 11, including the seal seams 36, 40. The opening aid 18 is preferably attached to the (unfolded) blank 12, or to the foil web, respectively. The retrieval opening 19 is marked by an opening flap 35 which is delimited by an encircling perforation line 38. The opening flap 35 (across the entire area) can be connected by adhesive bonding to the inner region of the closure tab 20. In this case, the opening flap 35 in the (initial) opening of the foil block 11 is detached from the composite with the blank 12, however remains connected to the closure tab 20. Alternatively, the opening flap 35, prior to attaching the closure tab 20, can be completely detached from the foil web or the blank 12 and be removed. In this case, an exposed (retrieval) opening 19 is covered by the closure tab 20. The latter, for this alternative, in the region of the opening 19 is configured without any adhesive, instead having only the glue strips 21, 22, 23 that are attached in the manner of a frame.

An (independent) particularity is the configuration of the glue regions, or of the glue pattern, respectively, for (releasably) connecting the closure tab 20 to the foil block 11. As can be seen in particular from FIG. 7, the closure tab 20 is provided with a glue pattern which is configured in the manner of a frame and surrounds the retrieval opening 19.

In the production, said glue pattern can be attached to the closure tab 20 (composed of a separate blank) and/or to the blank 12.

The glue pattern (preferably a PSA), in particular having longitudinal strips 21, transverse strips 22, and anchor strips 23, is configured so as to have dissimilar adhesive effects, so as to correspond to the stress in the opening and closing of the foil block 11. At least the transverse strip 22 is preferably configured so as to have a lower adhesive effect than the remaining portions of the glue pattern. Initial legs 39 of the longitudinal strips 21 are presently also configured so as to have a lower adhesive effect such that in particular the initiation of the opening procedure for the closure tab 20 is facilitated.

Figure 12:
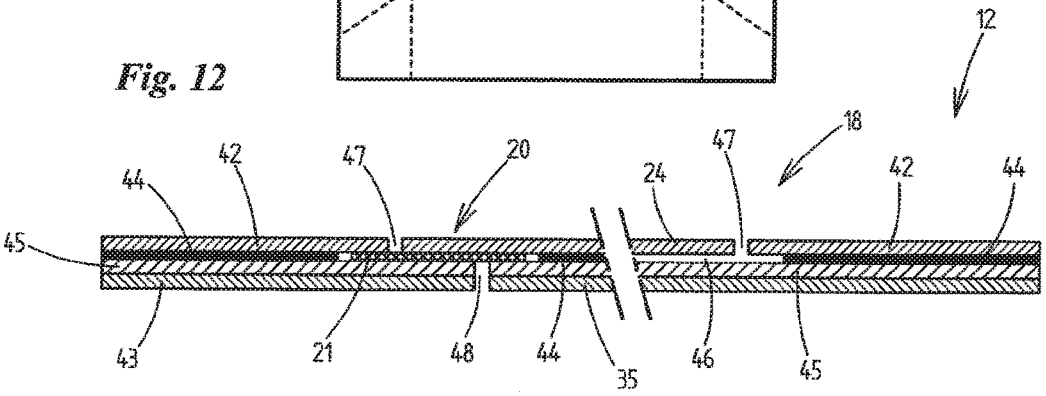
FIG. 12 shows a cross section XII-XII of the blank in FIG. 11, on an enlarged scale.
Figure 13:
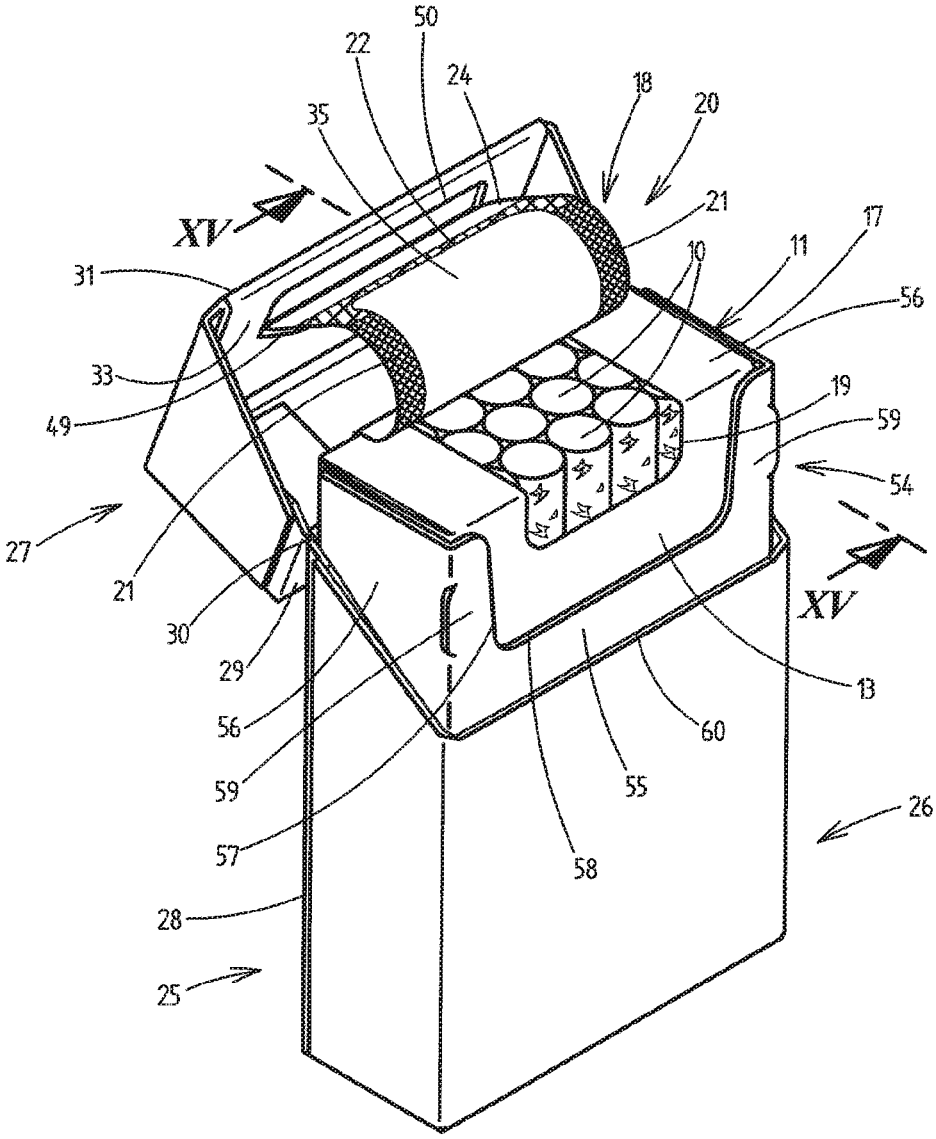
FIG. 13 shows a further embodiment of a pack in an (opened) illustration, in a manner analogous to that of FIG. 2.
Figure 15:
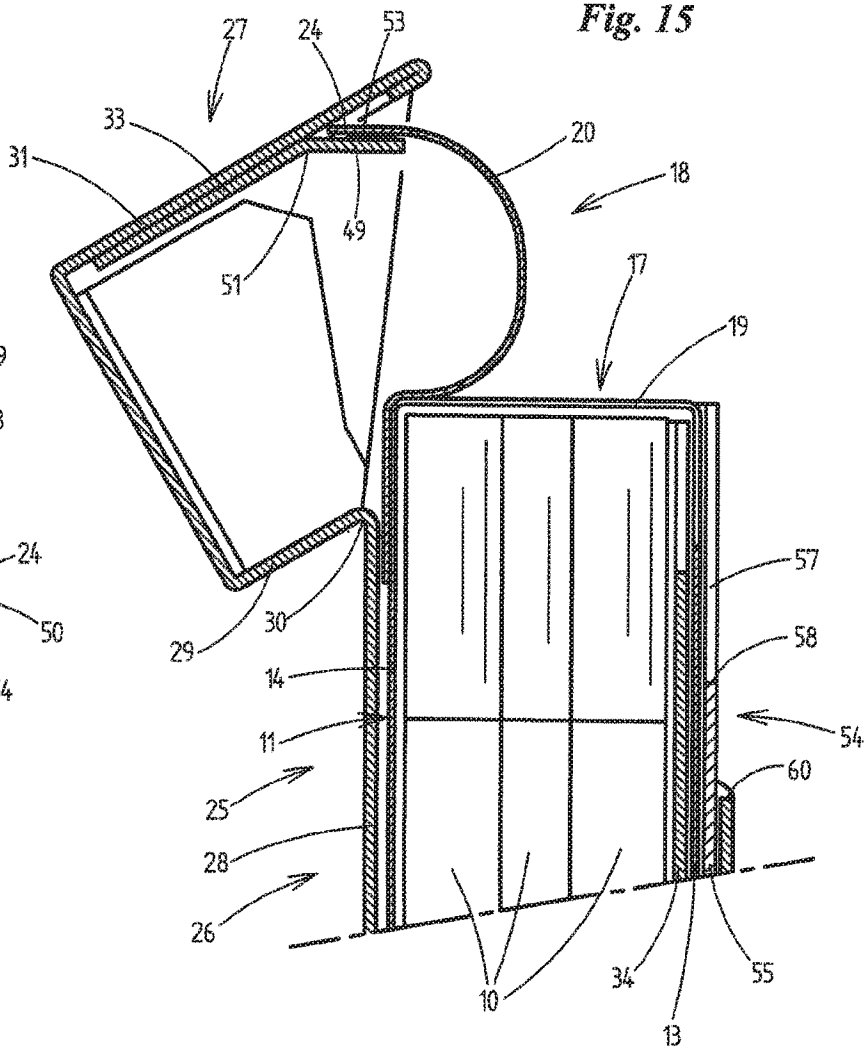
FIG. 15 shows a vertical section XV-XV in FIG. 13, in the case of an opened position.
Figure 14:
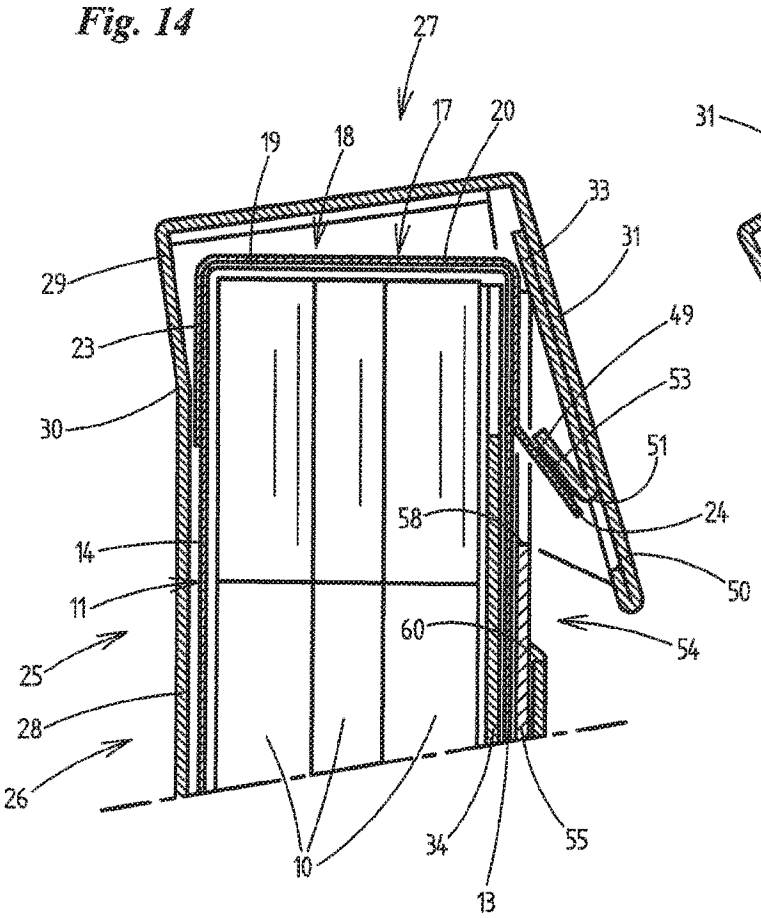
FIG. 14 shows a vertical section on the lid of the pack according to FIG. 13, in the case of an initial phase of the opening procedure.
Figure 17:
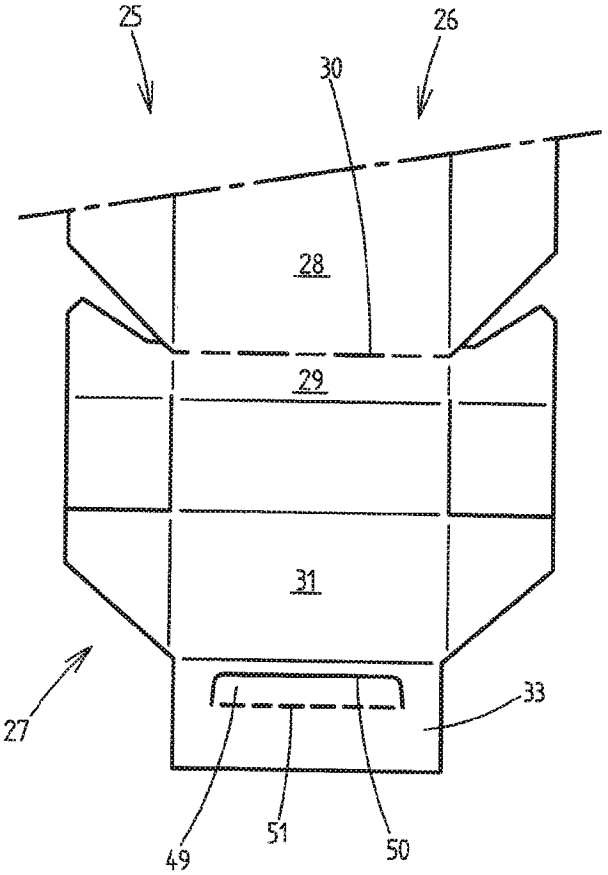
FIG. 17 shows a part-region on the lid of a spread-out blank for an (outer) pack according to FIG. 16.
Figure 16:
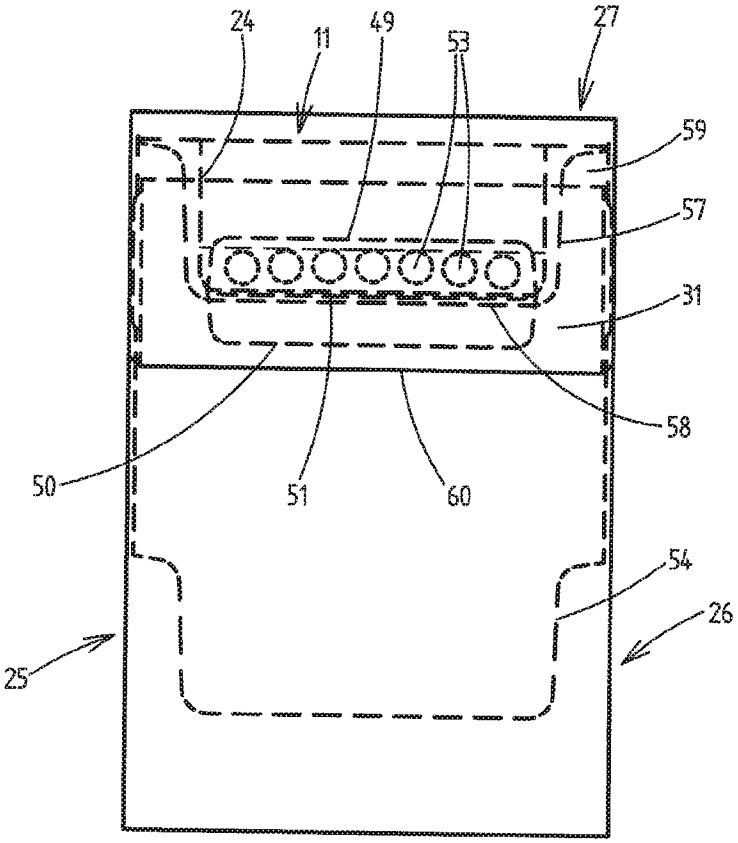
FIG. 16 shows the pack according to FIG. 13 to FIG. 15 in a front view, in the case of a closed lid.
Figure 19:
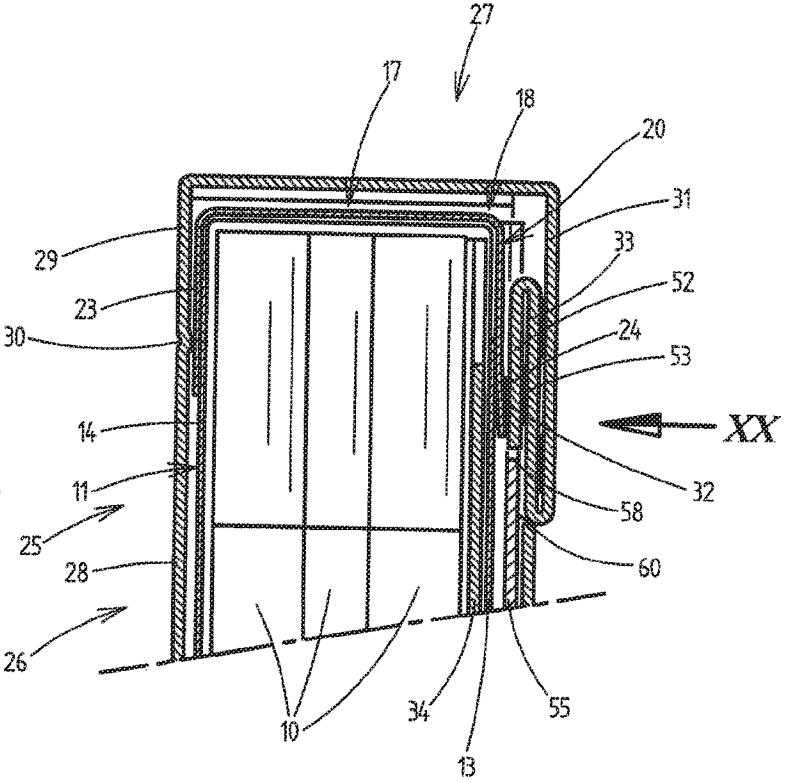
FIG. 19 shows a vertical section on the lid of the pack according to FIG. 18, in the case of a closed lid.
Figure 18:
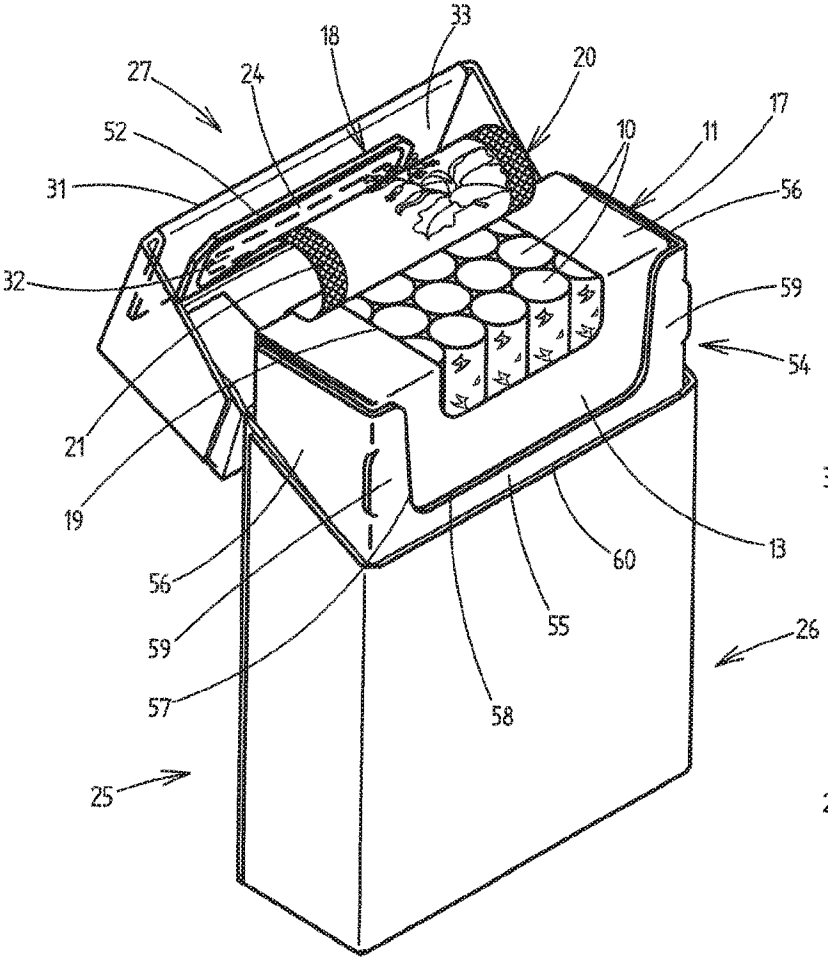
FIG. 18 shows another embodiment of a (sealed) pack in particular for cigarettes, in the case of an opened lid, in a perspective view.

A particular embodiment in terms of the sealed block or the foil block 11, respectively, and in particular in terms of the opening aid 18 is illustrated in FIG. 9 to FIG. 12. The foil for the foil block 11 is configured in multiple plies, and is composed in particular of two plies, or individual foils 42 and 43 (FIG. 12). Said individual foils 42 and 43 are largely interconnected across the full area by way of a glue layer 44 from a preferably non-releasable glue such that the individual foils 42, 43 in this region form an inseparable foil unit.

At least one of the individual foils 42, 43, presently the inner individual foil 43, is preferably configured so as to be aroma-proof and moisture-tight, preferably by way of a (metallic) barrier layer 45 that is attached by vaporization. Said barrier layer 45 here lies within the multi-ply foil. The glue layer 44 accordingly connects the individual foils 42, 43 in the region of the barrier layer 45.

The multi-ply foil configured in the manner described can be provided with an opening aid 18 which corresponds to that of the previous exemplary embodiments. However, the structure of the foil enables an opening aid 18 which is configured in a particular manner and which is integrated into the foil by utilizing the individual foils 42, 43.

The closure tab 20 is formed by the outside individual foil 42. The inner side individual foil 43 is processed such that the latter either forms an opening that has been attached during manufacture as a retrieval opening 19, or forms an opening tab, or an opening flap 35, respectively, which is detachable with the aid of the closure tab 20 in the opening procedure. Said opening flap 35 is connected (on the inner side) to the closure tab 20 by way of an adhesive bond preferably across the full area.

The opening aid 18 in the case of this pack is produced in the region of the blank 12 (FIG. 11), but preferably in the production of the (multi-ply) foil, specifically by applying dissimilar types of glue in a targeted manner, by forming glue-free regions between the individual foils 42, 43, and by attaching separation lines in a targeted manner in the individual plies 42, 43.

In the joining of the plies, or the individual foils 42, 43, areas that are required for the functionality of the opening aid 18 are preferably omitted, or are provided with glue simultaneously or in a temporally offset manner. In the present example, a U-shaped area between the individual foils 42, 43 is provided with releasable glue (PSA) in a manner analogous to that of the exemplary embodiment described for forming longitudinal strips 21 and transverse strips 22. Furthermore, in terms of applying the glue layer 44, a strip-shaped rectangular void 46 is achieved. There is no glue, thus neither the glue layer 44 nor the (PSA) glue of the opening aid 18, in this region. The grip or connecting flap 24, respectively, is located here.

In order for the closure tab 20 and/or the opening flap 35 to be formed, separation cuts or separation lines, respectively, are attached in the region of the opening aid 18 to be produced, preferably in the foil that in terms of the plies 42, 43, 44, 45 has been completed. The separation lines that are attached in the region of an individual ply are preferably produced by a laser and, on account thereof, in terms of the effectiveness are restricted to the respective ply.

The outer contour of the closure tab 20 is composed of a preferably continuous, thus uninterrupted, substantially U-shaped cut line 47 (only) in the region of the outer ply, thus of the individual foil 42. This cut line, by way of preferably approximately parallel legs, extends (at least partially) in the region of the inner end wall 17 and in an adjoining, end-side region of the inner front wall 13. In the case of the exemplary embodiment of FIG. 11, the cut line 47 by way of an end piece runs in the region of the inner rear wall 14. A transversely directed leg extends in the inner front wall 13 and delimits the connection flap 24. The cut line 47 determines the outer contour of the closure tab 20.

The inner side individual foil 43, by detaching the opening flap 35 formed by the individual foil 43, forms the retrieval opening 19, said opening flap 35 in the case of the present example being connected to the closure tab 20, preferably by way of the glue layer 44 that is disposed in a corresponding manner. The contour of the opening flap 35 is determined by a preferably likewise approximately U-shaped weakening line 48 which, by the application of respective technologies (laser) is restricted to the individual foil 43 (including the thin barrier layer 45). The weakening line 48 can be configured as a perforation, having residual connections, but preferably as a continuous cut line. The arrangement is presently such that the ends of the cut line 47, on the one hand, and of the weakening line 48, on the other hand, terminate so as to be adjacent to one another in the region of the inner rear wall 14.

The glue pattern of the opening aid 18, thus the U-shaped glue pattern having longitudinal strips 21 and transverse strips 22, in terms of the glue strength, are configured in the manner described (FIG. 5). The glue strips 21, 22 are dimensioned such that the cut line 47 and the weakening line 48, the latter completely, lie in the region of the glue pattern 21, 22, of course with the exception of the contour for the connection flaps 24. As can be seen from FIG. 11 and FIG. 12, the glue zone, preferably from PSA, is slightly wider than the spacing between the cut lines 47 and the weakening lines 48 such that the separation lines in this region are covered by the releasable adhesive.

The sealed block, or foil block 11, respectively, configured in this manner is coupled to the lid 27 of the outer pack 25 in the manner described. The (single ply) connection flap 24 is connected to the inner side of the freely pivotable lid inner flap 33 by means of glue (glue strip 32 and/or glue spots 41). The opening and closing procedure proceed in the manner described, wherein the closure tab 20 is connected to a U-shaped region of the inner individual foil that in the open position is exposed. Said inner foil is exposed in the case of an opened closure tab 20 (hatched area in FIG. 9).

In the case of the exemplary embodiment according to FIG. 13 to FIG. 17, the closure tab 20, or the connection flap 24 thereof, respectively, is connected to a separate (movable or pivotable, respectively) flap on the inner side of the lid 27. An activation flap 49 is attached to the inner side of the lid front wall 31, presently being part of the lid inner flap 33. Said activation flap 49 is provided with a U-shaped punched line 50 (FIG. 17) which delimits the activation flap 49 as part of the lid inner flap 33. The activation flap 49 has (longitudinal and transverse) dimensions that are smaller than those of the lid inner flap 33. The mobility, specifically the pivotability, of the flap 49 is achieved by a pivot line, or a linear joint 51, respectively, which in the case of the position of the lid inner flap 33 according to the pack faces the end wall. The lid inner flap 33, outside the region of the activation flap 49, is preferably connected to the lid front wall 31 by adhesive bonding in the usual manner.

The connection flap 24 is preferably connected to the inner side of the activation flap 49. The latter (in the production of the pack) is therefore folded to an upright position, corresponding approximately to FIG. 14. The inner side of the activation flap 49, on account thereof, faces the connection flap 24 and in the case of a closed lid 27 is located at the height of the flap 24. The connection between the flaps 24 and 49 is established by a glue connection, that is to say glue spots 41 on the outer side of the connection flap 24.

An interaction between the closure tab 20 and the activation flap 49 takes place when the outer pack 25 is opened. Said activation flap 49 herein is moved from an upwardly directed initial position (FIG. 14) to a downwardly directed end position (FIG. 15) at an acute angle to the lid front wall 31. The closure tab 20 herein is pulled from the closed position to the open position.

Figure 21:
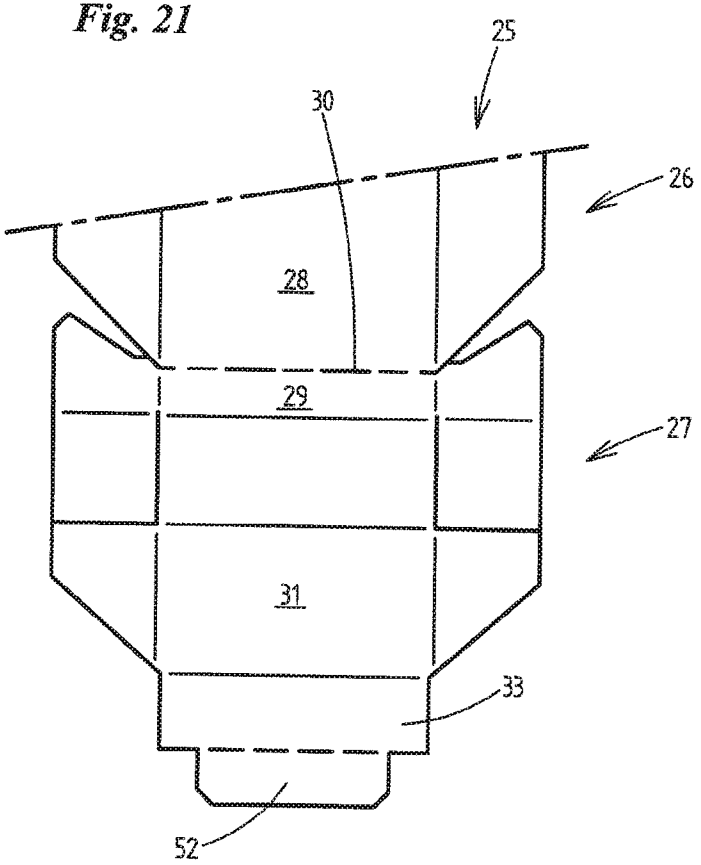
FIG. 21 shows a part-region of a blank in a manner analogous to that of FIG. 17, for the pack according to FIG. 18 to FIG. 20.
Figure 20:
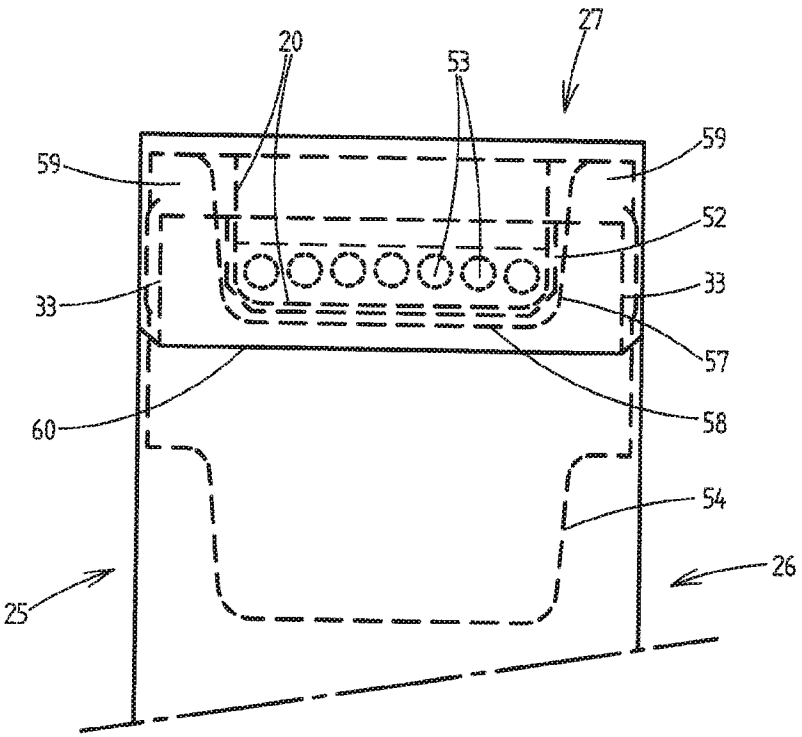
FIG. 20 shows a view of the front of the pack according FIG. 18, FIG. 19, according to the arrow XX.

In the case of the exemplary embodiment according to FIG. 18 to FIG. 21 too, the closure tab 20, or the connection flap 24 thereof, respectively, is fastened to a particular flap on the inner side of the lid front wall 31, in particular to a holding flap 52. The latter, preferably as part, or the continuation or appendage, respectively, of the lid inner flap 33, is attached to the inner side of the lid inner flap 33 (FIG. 21). The holding flap 52 bears on the free inner side of the (folded) lid inner flap 33 and is preferably connected to the latter by way of adhesive bonding, that is to say glue spots 53. The lid front wall 31, the lid inner flap 33, and the holding flap 52 are interconnected in a meandering fold while forming three plies. A three-ply lid front wall is thus created.

The closure tab 20, or the connection flap 24 thereof, respectively, by way of the free outer side is fastened to the free (inner) side of the holding flap 52 by adhesive bonding (glue strips 32). The closure tab 20 is pulled to the open position when the lid 27 is opened. The outer pack 25 in the embodiment as a hinge-lid box can be configured in the conventional manner, alternatively having a collar 54 or without a collar. The collar 54 is a commonplace part of a hinge-lid box per se, but can be omitted in the case of particular embodiments of a foil block 11, such as for example in the case of the pack according to FIG. 9 and FIG. 10.

The collar 54 is composed of a collar front wall 55 and transversely directed collar side flaps 56. The latter cover the inner side walls 15 of the foil block 11 above the box part 26.

A collar clearance 57 is usually located in the region of the collar front wall 55. Said collar clearance 57 is delimited by a curved collar edge 58. Collar webs 59 for delimiting the clearance 57 are formed laterally by the collar front wall 55.

In the case of the pack according to FIG. 2 to FIG. 6, the collar 54 is configured in a particular manner, specifically in such a manner that the collar clearance 57 extends into the region of the box part 26. The transversely directed portion of the collar edge 58 lies below a sealed edge 60 on the front side that is formed by the box part 26.

The sealed block 11, or the opening aid 18, respectively, in terms of design and dimension is adapted to the construction of the outer pack 25. In the case of the exemplary embodiment according to FIG. 1 to FIG. 6, the lid inner flap 33 as the activation flap for gripping the closure tab 20 is preferably tuned to the collar clearance 57, in particular in such a manner that the lid inner flap 33 in the case of a closed lid 27 (completely) finds a receptacle between the collar webs 59, thus within the collar clearance 57. Accordingly, the lid inner flap 33 in the case of this solution is configured so as to have a width that is smaller than that of the lid front wall 31.

In the case of the exemplary embodiment according to FIG. 13 to FIG. 17, a collar 54 in a conventional embodiment is preferably provided. Here too, the activation flap 49 is tuned to the dimensions of the collar 54, in particular in such a manner that the activation flap 49 in the case of a closed lid lies within the clearance 57, in any case not covering the latter laterally in the region of the collar webs 59. The linear joint 51 of the flap 49 is preferably disposed in the region of the transversely directed portion of the collar edge 58, preferably so as to be slightly above said edge 58, thus so as to be in the region of the clearance 57.

Tuning in terms of the design of the holding flap 52 to the collar 54, or to the collar clearance 57, respectively, is also provided in the case of the exemplary embodiment according to FIG. 18 to FIG. 21, in particular in such a manner that the holding flap 52 in the case of a closed lid (FIG. 19) completely finds a receptacle in the clearance 57 of the collar 54. The (downwardly directed) holding flap 52 lies in particular in the plane of the collar front wall 55. A bearing of the holding flap 52 on the connection flap 24, or on the glue locations thereof, respectively, is thus achieved in the case of a closed lid.

LIST OF REFERENCE SIGNS

10 Cigarette
11 Foil block
12 Blank
13 Inner front wall
14 Inner rear wall
15 Inner side wall
16 Inner base wall
17 Inner end wall
18 Opening aid
19 Retrieval opening
20 Closure tab
21 Longitudinal strip
22 Transverse strip
23 Anchor strip
24 Connection flap
25 Outer pack
26 Box part
27 Lid
28 Box rear wall
29 Lid rear wall
30 Linear joint
31 Lid front wall
32 Glue strip
33 Lid inner tab
34 Tray
35 Opening tab
36 Lateral seam
37 Folding edge
38 Perforation line
39 Initial leg
40 Transverse seam
41 Glue spot

42 Individual foil
43 Individual foil
44 Glue layer
45 Barrier layer
46 Void
47 Cut line
48 Weakening line
49 Activation tab
50 Punched line
51 Linear joint
52 Holding flap
53 Glue spot
54 Collar
55 Collar front wall
56 Collar side flap
57 Collar clearance
58 Collar edge
59 Collar web
60 Sealed edge
61 Embossed line

The invention claimed is:

1. A pack for cigarettes (10) or other smokers' items, comprising:

an outer pack (25) having a box part (26) and a lid (27);

an inner pack in the form of a sealed foil block (11) having a blank (12) from foil which surrounds a cigarette group, wherein the foil block (11) has an opening aid (18), wherein the opening aid (18) has a closure means or closure tab (20), which is fastened to the foil block (11) by means of a releasable adhesive bond and for opening the foil block (11) is at least partially torn off from the foil block (11) and on account thereof at least partially exposes a retrieval opening (19), wherein:

a) the closure tab (20) by way of a grip end, is connected to an activation flap of the lid (27) of the outer pack (25), the activation flap being movable in a pivotable manner relative to the lid (27); and b) when opening the lid (27), the closure tab (20) by virtue of a tuned pivoting movement of the activation flap relative to the lid (27), is movable to an open position.

2. The pack as claimed in claim 1, wherein the activation flap, which in terms of the entirety or of part-regions thereof is movable in a freely pivotable manner and is connected to the closure tab (20) or to a connection flap (24) attached to the closure tab (20), respectively, is attached to an inner side of a lid front wall (31) of the lid (27).

3. The pack as claimed in claim 2, further comprising a lid inner flap (33) that is not connected by glue to the lid front wall (31) wherein the inner flap (33) serves as the activation flap for the closure tab (20), wherein an activation end, or the connection flap (24), respectively, of the closure tab (20) is connected by adhesive bonding to a free inward pointing side of the lid inner flap (33) in such a manner that the lid inner flap (33) when opening the lid (27) by virtue of pivoting movements is movable along a linear joint first to an initial position, and thereafter by way of a continuing pivoting movement is movable to a transverse position, and finally to a stretched position, or to a position that has an obtuse angle relative to the lid front wall (31), in each case while entraining the closure tab (20).

4. The pack as claimed in claim 3, wherein at the beginning of the opening procedure, the connection flap (24) that is connected to the activation flap or to the lid inner flap (33) respectively, by virtue of the activation of the lid (27) of the outer pack (25), is pivotable first to an oblique position and thereafter to a transversely-directed position, wherein the procedure of opening can be initiated by tearing off the closure tab (20) from the foil block (11) only once an upwardly directed oblique position of the connection flap (24) has been reached.

5. The pack as claimed in claim 3, wherein the activation flap is part of the lid (27).

6. The pack as claimed in claim 5, wherein the activation flap is part of the lid inner flap (33) and is pivotable along a folding line, or along a linear joint (51), respectively, wherein the linear joint (51) lies on a side facing the end side of the pack, the activation flap in an initial position thus being directed downward.

7. The pack as claimed in claim 5, wherein the activation flap for the closure tab (20) is attached as holding flap to an inner side of the lid (27), or to the inner side of the lid front wall (31), respectively.

8. The pack as claimed in claim 7, wherein the holding flap is configured as a peripheral flap, or a continuation of the lid inner flap (33), respectively, and is connected to the inner flap (33) in an integral manner, wherein the holding flap is folded toward the free side of the lid inner flap (33).

9. The pack as claimed in claim 1, wherein:

a) the blank (12) for the foil block (11) is composed of at least two planar plies or individual foils (42, 43), respectively, outer individual foil (42) and inner individual foil (43), that are permanently interconnected, of which at least one ply, or one individual foil (42, 43), respectively, is configured as a sealing foil;

b) the plies or individual foils (42, 43), respectively, for forming an opening aid (18) are provided with dividing or separating cuts, respectively; and c) the inner individual foil (43), for delimiting an opening flap that is configured as part of the inner individual foil (43), is provided with cut or weakening lines (48), respectively, that are applied so as to be offset in relation to a cut line (47) provided to the outer individual foil (42).

10. The pack as claimed in claim 9, wherein the cut line (47) for delimiting the closure tab (20) in the outer individual foil (42) is configured so as to be U-shaped and also delimits the a glue-free connection flap (24) attached to the closure tab (20) as part of the outer individual foil (42), and in that the cut or weakening line (48) of the inner individual foil (43) that is disposed within the U-shaped cut line (47) for delimiting on three sides an opening flap (35) that is assigned to the retrieval opening (19) is configured so as to be approximately U-shaped.

11. The pack as claimed in claim 1, further comprising glue, or glue areas (21, 22, 23), that are applied to the closure tab (20) for connecting the closure tab (20) to the foil block (11) has/have regions with dissimilar adhesive intensities or forces, respectively.

12. The pack as claimed in claim 7, wherein in the case of a configuration of the outer pack (25) as a hinge-lid box having the box part (26), the lid (27), and the collar (54), the activation flap, in terms of the shape and in particular of the dimensions is configured such that the activation flap in the case of when the lid (27) is closed finds a receptacle within a collar clearance (57) in a collar front wall (55) in such a manner that the activation flap in the case of when the lid (27 is closed bears directly on the foil block (11).

13. The pack as claimed in claim 3, wherein the activation flap that is connected to the lid (27) of the outer pack (25), by virtue of a pretreatment, while entraining the closure tab (20) is deformable when opening the lid (27).

14. The pack as claimed in claim 1, wherein the opening aid (18) is located in the end-side region of an inner front wall (13) of the foil block (11) and at least in a part-region of an inner end wall (17) of the foil block.

15. The pack as claimed in claim 1, wherein the grip end connecting the closure tab (20) to the activation flap of the lid (27) is a glue-free connection flap (24).

16. The pack as claimed in claim 3, wherein the lid inner flap (33) that is not connected by glue to the lid front wall (31) is in an initial position that bears on the inner side of the lid front wall (31).

17. The pack as claimed in claim 5, wherein the activation flap is part of the lid inner flap (33) of the lid (27).

18. The pack as claimed in claim 17, wherein the activation flap is a separate activation flap (49) which is formed by a U-shaped punching line (50) and is connected to the closure tab (20) or to the connection flap (24), respectively.

19. The pack as claimed in claim 7, wherein the activation flap for the closure tab (20) that is attached as holding flap to the inner side of the lid (27), or to the inner side of the lid front wall (31), respectively, is attached to the free side of the lid inner flap (33).

20. The pack as claimed in claim 19, wherein the activation flap for the closure tab (20) is attached to the free side of the lid inner flap (33) in such a manner that the holding flap (52), as an inwardly directed third ply of the lid front wall (31) in a closed position of the lid (27), bears on the connection flap (24).

21. The pack as claimed in claim 20, wherein the holding flap (52) bears on a glue area of the connection flap (24).

22. The pack as claimed in claim 9, wherein the plies or individual foils (42, 43), respectively, for forming the opening aid (18) are provided with the dividing or separating cuts, respectively, in such a manner that the cut line (47) provided to the outer individual foil (42), which cut line (47) is for delimiting the outer contour of the closure tab (20) that is formed exclusively by the outer individual foil (42), is limited to the respective outer individual foil (42).

23. The pack as claimed in claim 12, wherein the activation flap is the lid inner flap (33) that is connected to the connection flap (24).

24. The pack as claimed in claim 12, wherein the activation flap is configured as part as the lid inner flap (33).

25. The pack as claimed in claim 12, wherein the activation flap is a holding flap (52) that is connected to the lid inner flap (33).

* * * * *